US012144424B2

(12) United States Patent
Anderson

(10) Patent No.: US 12,144,424 B2
(45) **Date of Patent: *Nov. 19, 2024**

(54) FLOATING SHELF BRACKET

(71) Applicant: Silicate Studio Home, LLC, Rexburg, ID (US)

(72) Inventor: Kevin Anderson, Rexburg, ID (US)

(73) Assignee: Silicate Studio Home, LLC, Rexburg, ID (US)

( * ) Notice: Subject to any disclaimer, the term of this patent is extended or adjusted under 35 U.S.C. 154(b) by 9 days.

This patent is subject to a terminal disclaimer.

(21) Appl. No.: 18/094,717

(22) Filed: Jan. 9, 2023

(65) Prior Publication Data

US 2024/0090667 A1 Mar. 21, 2024

Related U.S. Application Data

(63) Continuation-in-part of application No. 17/972,352, filed on Oct. 24, 2022, now Pat. No. 12,011,088, (Continued)

(51) Int. Cl.
*A47B 96/06* (2006.01)

(52) U.S. Cl.
CPC ..... *A47B 96/061* (2013.01); *A47B 96/066* (2013.01)

(58) Field of Classification Search
CPC ... A47B 96/066; A47B 96/028; A47B 95/008; A47B 96/06; A47B 96/063;
(Continued)

(56) References Cited

U.S. PATENT DOCUMENTS 1,240,863 A 9/1917 Lyda
2,733,786 A * 2/1956 Drake ..... E04C 3/09 403/4

(Continued)

FOREIGN PATENT DOCUMENTS

FR 2664142 1/1992
FR 3073722 5/2019

(Continued)

OTHER PUBLICATIONS

Mastershelf, Floating Shelf Bracket, mastershelf.co.uk (online), available from http://web.archive.org/web/20151220102933/https://mastershelf.co.uk/shop/brackets-2/floating-shelving-brackets/floating-shelf-bracket-5/, Dec. 20, 2015, accessed Aug. 15, 2023, 1 page.

(Continued)

*Primary Examiner* — Ko H Chan
(74) *Attorney, Agent, or Firm* — Thorpe North & Western, LLP

(57) ABSTRACT

A bracket for a floating shelf comprises rods secured to and extending from a solid plate to be secured to a wall. Interleaved arrays of countersunk bores and slots extend through the solid plate and arranged to extend laterally from one lateral side of the solid plate to an opposite lateral side of the solid plate. An array of webs in the plate is interleaved between the arrays of bores and slots. Each web has a lateral width less than or equal to inch so that fastener inserted through the bores and slots can always find a stud. The plate has a perimeter and at least one cutout at a lateral end sized to receive a tool to separate the bracket from the shelf.

20 Claims, 7 Drawing Sheets

Related U.S. Application Data which is a continuation-in-part of application No. 17/958,612, filed on Oct. 3, 2022.

(60) Provisional application No. 63/270,723, filed on Oct. 22, 2021.

(58) Field of Classification Search
CPC .. A47B 96/061; F16B 5/0614; F16B 13/0808; F16B 35/005; F16B 41/002; F16B 9/054; F16B 7/042; F16B 11/008; F16M 13/02; E04B 2001/389
See application file for complete search history.

(56) References Cited

U.S. PATENT DOCUMENTS

| | | | | |
|---|---|---|---|---|
| 3,333,555 | A | 8/1967 | Kapnek | |
| 3,565,020 | A | 2/1971 | Schier et al. | |
| 3,752,088 | A | 8/1973 | Kapnek et al. | |
| 3,837,605 | A | 9/1974 | Sicard | |
| 3,895,413 | A | 7/1975 | Buergers | |
| D304,212 | S * | 10/1989 | Moe | D21/486 |
| 5,026,012 | A | 6/1991 | Wang | |
| 5,265,971 | A | 11/1993 | Duc | |
| 5,346,169 | A | 9/1994 | Polonsky | |
| D371,506 | S * | 7/1996 | Nofziger | D8/354 |
| 5,785,187 | A | 7/1998 | Lipman et al. | |
| 5,810,303 | A * | 9/1998 | Bourassa | H02G 3/126 248/300 |
| 5,813,550 | A | 9/1998 | Sheehan et al. | |
| 5,845,453 | A | 12/1998 | Goya | |
| 5,908,121 | A * | 6/1999 | Dardashti | A47B 87/0215 211/188 |
| 5,954,306 | A | 9/1999 | Hoover | |
| 6,018,923 | A * | 2/2000 | Wendt | E04B 9/16 52/712 |
| 6,164,610 | A | 12/2000 | Santiago | |
| 6,268,574 | B1 | 7/2001 | Edens | |
| D448,650 | S * | 10/2001 | Vrame | D8/356 |
| 6,311,407 | B1 | 11/2001 | Muraishi | |
| 6,182,937 | B1 | 12/2001 | Sanderse | |
| 6,467,636 | B1 | 10/2002 | Schaefer | |
| 6,499,608 | B1 | 12/2002 | Sterling et al. | |
| 6,848,659 | B1 | 2/2005 | Liu et al. | |
| D552,947 | S * | 10/2007 | Ewasiuk | D8/5 |
| 7,578,107 | B2 * | 8/2009 | Platt | E04B 9/30 52/506.09 |
| 7,930,864 | B2 * | 4/2011 | Wendt | E04B 9/30 52/712 |
| D637,897 | S * | 5/2011 | Tedesco | D8/394 |
| 8,082,859 | B2 | 12/2011 | Sevack | |
| 8,117,793 | B2 * | 2/2012 | Jankovec | E04B 9/122 52/506.07 |
| D664,029 | S * | 7/2012 | Mathur | D8/394 |
| D679,176 | S * | 4/2013 | Tedesco | D8/394 |
| 8,602,372 | B2 | 12/2013 | Yu | |
| 8,615,948 | B2 * | 12/2013 | Underkofler | E04B 9/067 52/506.07 |
| 8,689,519 | B2 | 4/2014 | Zelich | |
| 8,763,336 | B2 * | 7/2014 | Gulbrandsen | E04B 9/10 52/506.07 |
| 8,898,986 | B1 * | 12/2014 | Underkofler | E04B 9/125 52/506.07 |
| 9,185,979 | B1 | 11/2015 | Jenks et al. | |
| 9,416,536 | B1 * | 8/2016 | Lehane | E04B 9/183 |
| 9,861,198 | B2 | 1/2018 | Anderson | |
| 9,891,198 | B2 | 2/2018 | Sutan | |
| 10,561,958 | B2 * | 2/2020 | Purwar | A63H 33/12 |
| 10,575,641 | B1 | 3/2020 | Severa | |
| 10,588,412 | B2 | 3/2020 | Graber et al. | |
| 10,598,264 | B2 * | 3/2020 | Zheng | B25J 9/08 |
| D892,599 | S | 8/2020 | Witherbee | |
| 11,013,326 | B2 | 5/2021 | Graber et al. | |
| D937,936 | S * | 12/2021 | Pettey | D21/501 |
| 11,384,536 | B1 * | 7/2022 | Gulbrandsen | E04C 3/04 |
| 11,432,648 | B1 | 9/2022 | Black et al. | |
| 2002/0104946 | A1 | 8/2002 | Lai | |
| 2005/0127017 | A1 | 6/2005 | Kessel et al. | |
| 2007/0125738 | A1 | 6/2007 | Sevack | |
| 2008/0104946 | A1 | 5/2008 | Wang et al. | |
| 2008/0121146 | A1 | 5/2008 | Burns et al. | |
| 2008/0151483 | A1 | 6/2008 | Holbrook et al. | |
| 2009/0223146 | A1 * | 9/2009 | Platt | E04B 9/10 52/745.2 |
| 2009/0224119 | A1 | 9/2009 | Hefferman | |
| 2011/0147551 | A1 | 6/2011 | Richard et al. | |
| 2013/0048584 | A1 | 2/2013 | Kaperst et al. | |
| 2014/0217252 | A1 | 8/2014 | Fitzgerald et al. | |
| 2014/0352249 | A1 * | 12/2014 | Jankovec | E04B 9/127 52/665 |
| 2017/0215586 | A1 | 8/2017 | Zonneveld | |
| 2020/0205568 | A1 | 7/2020 | Stanford | |
| 2020/0275794 | A1 | 9/2020 | Kuechle | |
| 2021/0071699 | A1 | 3/2021 | Bastian et al. | |
| 2023/0058224 | A1 * | 2/2023 | Evans | E04B 1/2608 |

FOREIGN PATENT DOCUMENTS

| | | |
|---|---|---|
| GB | 2214414 | 9/1989 |
| KR | 20190084215 | 7/2019 |

OTHER PUBLICATIONS

Lumberjocks, "Supporting floating shelves," http://web.archive.org/web/20150527104027/http://lumberjocks.com/topics/58185 Believed to be publically available as of May 27, 2015. 4 pgs.

Lumberjocks, "Supporting floating shelves," http://web.archive.org/web/20150321053613/http"//lumberjocks.com:80/topics/47100 Believed to be publically available as of Mar. 21, 2015. 8 pgs.

The Shelving Shop, "Floating shelf bracket," http://www.shelvingshop.com.au:80/shopexd.asp?id=832 Believed to be publically available as of Nov. 30, 2012. 3 pgs.

Silicatestudio," Brad's Bomb-diggity Custom Brackets," https://www.etsy.com/listing/222309673/brads-bomb-diggity-custom-brackets Believed to be publically available as of Feb. 11, 2015. 5 pgs.

Silicatestudio."Brad's Bomb-diggity Custom Brackets," https://www.etsy.com/shop/SilicateStudio/reviews?ref=pagination&page=34 Believed to be publically available as of Feb. 17, 2015. 4 pgs.

* cited by examiner

FLOATING SHELF BRACKET

PRIORITY CLAIM(S) AND RELATED APPLICATION(S)

This is a continuation-in-part of U.S. patent application Ser. No. 17/972,352, filed Oct. 24, 2022, which is a continuation-in-part of U.S. patent application Ser. No. 17/958,612, filed Oct. 3, 2022, which claims priority to U.S. Provisional Patent Application Ser. No. 63/270,723, filed Oct. 22, 2021, which are hereby incorporated herein by reference.

This is a continuation-in-part of U.S. patent application Ser. No. 17/972,352, filed Oct. 24, 2022, which claims priority to U.S. Provisional Patent Application Ser. No. 63/270,723, filed Oct. 22, 2021, which are hereby incorporated herein by reference.

BACKGROUND

Shelves can be attached to walls using various support structures, such as brackets. Some support structures for wall-mounted shelves are able to support higher amounts of weight than others. Support structures that are able to support higher amounts of weight tend to be bulkier and more visible than support structures that support lower amounts of weight. A consumer may find a highly visible support structure on a wall to be undesirable in a room where the consumer wishes to establish a certain décor. Improvement to shelves and brackets is an ongoing endeavor.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
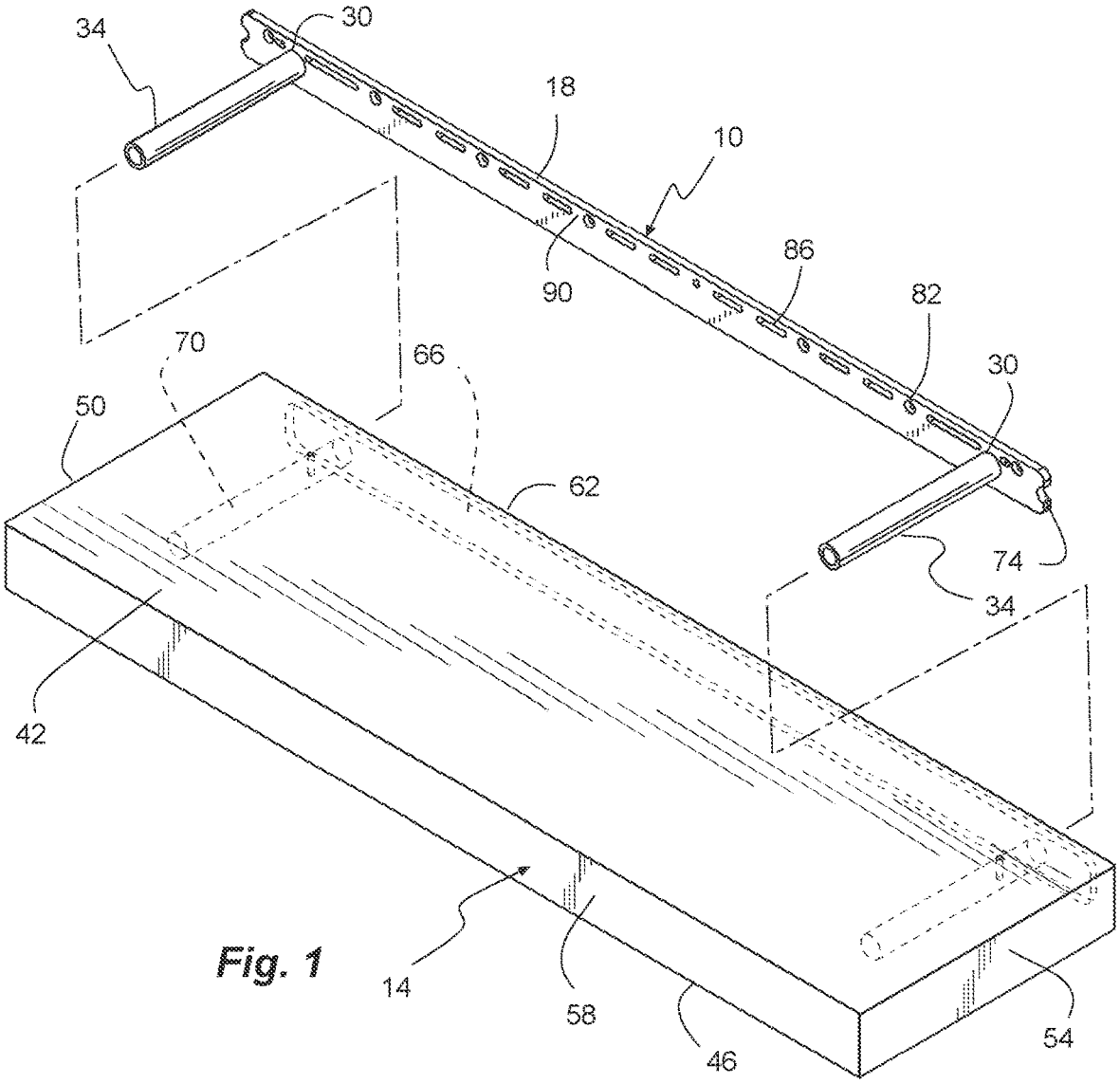
FIG. 1 is an exploded perspective view of a bracket and a floating shelf in accordance with an embodiment of the invention.
Figure 2:
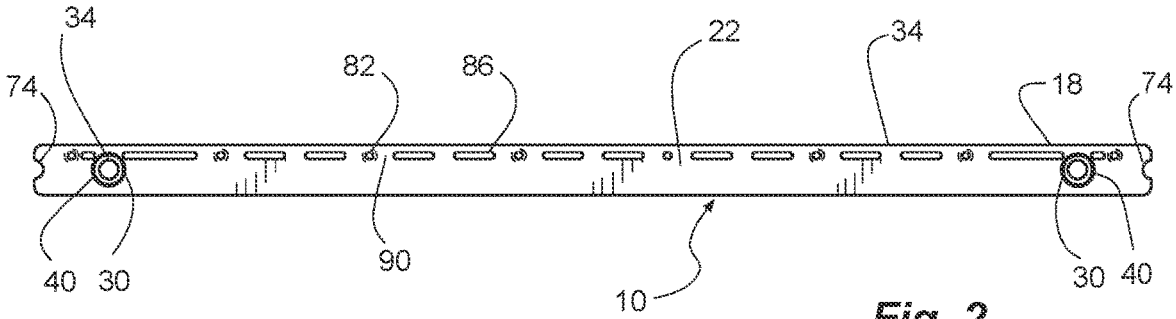
FIG. 2 is a rear view of the bracket of FIG. 1.
Figure 3:
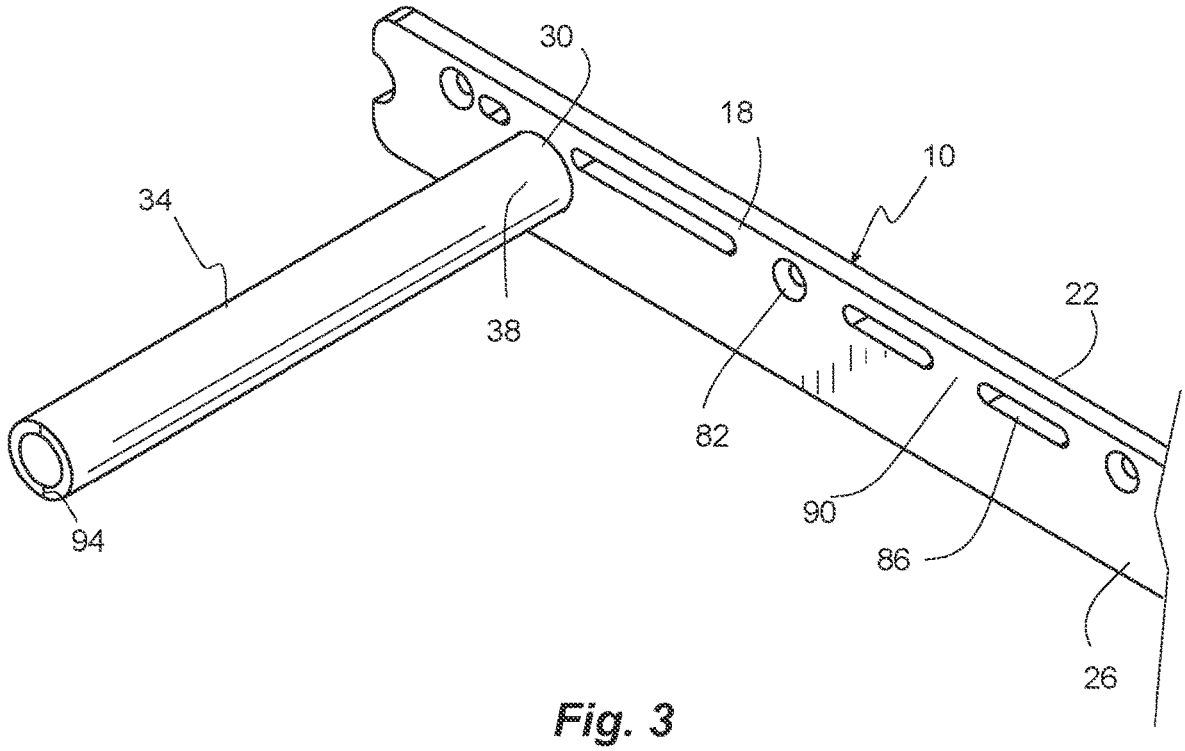
FIG. 3 is a partial perspective view of the bracket of FIG. 1.
Figure 4:
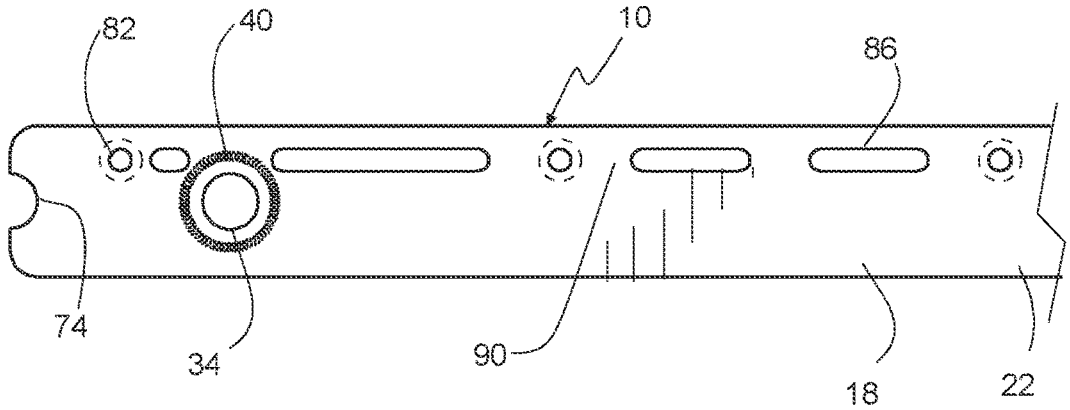
FIG. 4 is a partial rear view of the bracket of FIG. 1.
Figure 5:
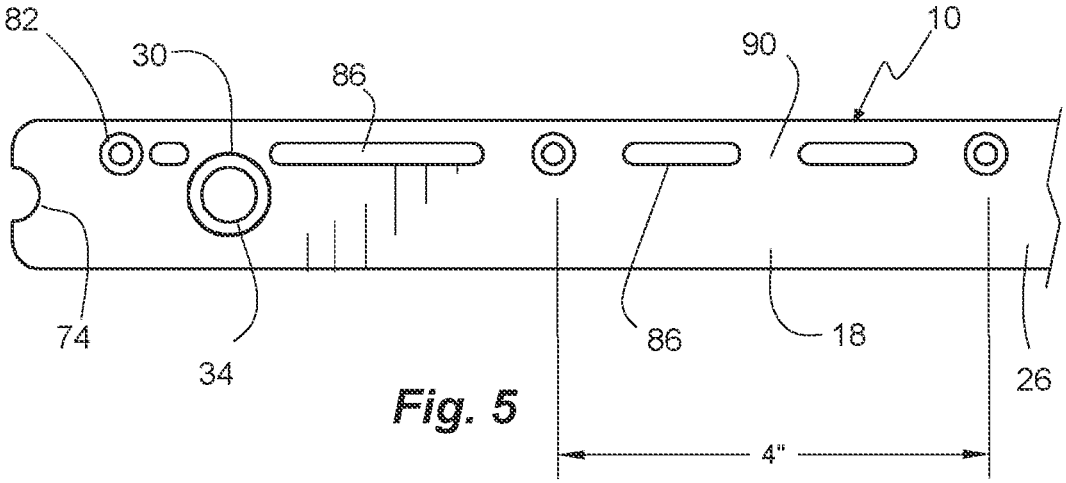
FIG. 5 is a partial front view of the bracket of FIG. 1.
Figure 6:
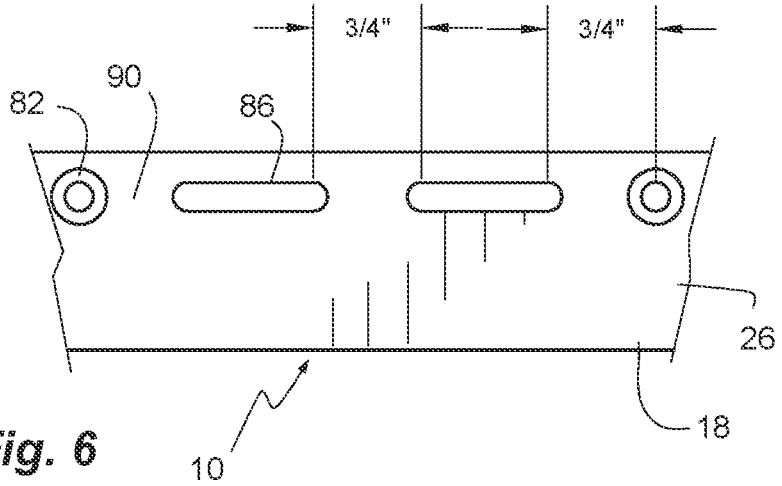
FIG. 6 is a partial front view of the bracket of FIG. 1.

While the brackets are shown with two rods by way of example, the brackets can have any number of rods.

Reference will now be made to the exemplary embodiments illustrated, and specific language will be used herein to describe the same. It will nevertheless be understood that no limitation of the scope of the invention is thereby intended.

DETAILED DESCRIPTION

Before invention embodiments are disclosed and described, it is to be understood that no limitation to the particular structures, process steps, or materials disclosed herein is intended, but also includes equivalents thereof as would be recognized by those ordinarily skilled in the relevant arts. It should also be understood that terminology employed herein is used for the purpose of describing particular examples only and is not intended to be limiting. The same reference numerals in different drawings represent the same element. Numbers provided in flow charts and processes are provided for clarity in illustrating steps and operations and do not necessarily indicate a particular order or sequence. Unless defined otherwise, all technical and scientific terms used herein have the same meaning as commonly understood by one of ordinary skill in the art to which this disclosure belongs.

An initial overview of the inventive concepts are provided below and then specific examples are described in further detail later. This initial summary is intended to aid readers in understanding the examples more quickly, but is not intended to identify key features or essential features of the examples, nor is it intended to limit the scope of the claimed subject matter.

A bracket is provided for mounting a shelf to a flat vertical surface, such as a wall. The bracket can have a high ratio of weight-supporting capacity to visibility relative to some other wall-mountable shelf-supports.

When decorating a room, a consumer may wish to mount shelves to one or more walls to provide increased space for display or storage. Many wall-mountable shelf-supports (e.g., brackets) are mounted below the shelves they support, and therefore remain visible beneath the shelves after installation is complete. Other varieties of shelf-support brackets are mounted above the shelves they support, but likewise remain visible after installation is complete.

Some consumers may wish to mount a shelf to a wall but may not wish for the bracket that supports the shelf to be conspicuously visible. A shelf that is supported by a bracket that is not conspicuously visible is sometimes referred to as a floating shelf, since the shelf may appear to float due to the low visibility of the supporting bracket.

There is often a trade-off between visibility and weight-supporting strength because a bracket that is less conspicuous tends to be smaller and tends to absorb the stress of weight borne by a shelf over a smaller area. Consequently, consumers who wish to store or display relatively heavy items on floating shelves may have difficulty finding brackets that provide both a desired high level of weight-bearing capacity and a desired low level of bracket visibility.

Brackets designed in accordance with the design principles described herein provide a high ratio of weight-supporting capacity to visibility relative to some existing commercial support brackets for floating shelves. The bracket is configured to be mounted to the wall in differ ways. In one aspect, the bracket can be directly mounted to blocking and studs of the wall using an array of countersunk bores. A wall panel, such as drywall, shiplap, etc. can be mounted over a plate of the bracket with rods extending through holes in the wall panel. In another aspect, the bracket can be directly mounted to the wall panel using an array of slots. The bores and slots can be interleaved and spaced-apart by webs. The webs can have a thickness less than ¾ inches so that the slots and/or bores can always align with a stud (based on standard 16 inch spacing).

In one example, a bracket for supporting a shelf may comprise a solid plate with a planer back side, apertures extending through the plate, and rods secured to and extending from the plate and received within the aperture. The plate and the rods may be made of steel or another metal. A proximal end of the rod can be joined to the flat back side of the plate at a back end of the aperture. The proximal end of the rod can be joined to the flat back side of the plate by a weld that extends along a shared (i.e., by the proximal end of the rod and by the back end of the aperture of the plate) cross-sectional perimeter of the cross-sectional shape at the back end of the aperture. The weld can fully encompass the shared cross-sectional perimeter. The rod can be secured to a back side of the plate by a weld around a circular perimeter of the rod and the aperture in the plate. In addition, the proximal end of the rod and the weld can be flush with the back side of the plate. When the rod is positioned in the aperture in the plate and the proximal end of the rod is joined to the flat back side of the plate (e.g., by a weld), a bracket with increased weight-bearing capacity results. By contrast, a bracket with an elongate member that is merely spot welded to the front side of the base would have comparably less weight-bearing capacity.

The bracket can also comprise an array of countersunk bores and an array of slots for fasteners. The array of bores can facilitate a strong connection to the wall while the array of slots can facilitate alignment of the fasteners with studs in the wall. The bores/slots and fasteners may be positioned closer to the top side of the plate. The bores/slots can be interleaved. Fasteners, such as screws (e.g., wood screws), bolts (e.g., carriage bolts or lag bolts), anchors (e.g., masonry anchors or drywall anchors), or nails, may be inserted through the bores and/or slots and into a wall in order to secure the bracket to the wall. The bores can be counterbores with enlarged openings to receive the heads of the fasteners to reduce interference with a surface panel mounted over the plate.

A distal end of the rod may extend outwardly from the front side of the plate. Specifically, the distal end of the rod may extend outwardly from the front side of the plate in a direction that is substantially orthogonal to a plane formed by the flat back side of the plate. Hence, when the bracket is mounted, the rod may extend outwardly from the front side of the plate in a direction that is substantially orthogonal to a plane formed by the wall. The rod can be a pipe to reduce weight of the bracket.

The rod may also comprise an aperture for a fastener. A shelf with a channel to receive the rod can be slid onto the rod until the shelf contacts the front side of the plate or until the distal end of the rod contacts an end of the channel. The shelf may have an aperture for a fastener that lines up with the rod's aperture for a fastener when the shelf is properly situated on the rod so that a fastener can be inserted through the shelf's aperture and the rod's aperture in order to secure the shelf to the rod.

The plate may form a rectangular prism. The width of the rectangular prism formed by the plate can be greater than the height of the rectangular prism, while the height of the rectangular prism may be greater than the depth of the rectangular prism. Optionally, the width of the plate may be no greater than the width of the shelf and the height of the plate may be no greater than the height of the shelf in order to reduce visibility of the bracket when the shelf is secured to the wall using the bracket.

Referring to FIGS. 1-15, a bracket 10 and a floating shelf 14 in an example of the invention are shown. The bracket 10 mounts the floating shelf 14 to a vertical surface, such as a wall 16 (FIGS. 7-10). The bracket 10 can comprise a solid plate 18 with a planar back side 22 to abut to the wall 16 and a planar front side 26. The plate 18 is solid from the planar front side 26 to the planar back side 22, and from a front surface to a back surface, except for apertures as described below. The plate 18 is solid as opposed to tubes or channels that have a hollow interior, or a space between the front and back surfaces. The solid plate 18 can provide strength with minimal thickness to facilitate hiding the bracket 10. The solid plate 18 can have an elongated rectangular shape with a rectangular perimeter. The solid plate 18 can form a rectangular prism, with a width of the rectangular prism being greater than a height of the rectangular prism, and the height of the rectangular prism being greater than a depth of the rectangular prism. Thus, the plate 18 can be sized and shaped to support an elongated lateral shelf 14. In one aspect, the plate can have a thickness or depth of approximately ¼ inch.

A plurality of circular apertures 30 can each extend through the solid plate 18 from the planar front side 26 and through the planar back side 22 of the solid plate 18. In one aspect, the plate 18 can be formed of metal, such as being cut from bar stock. In another aspect, the apertures 30 can be formed by drilling or laser cutting.

A plurality of rods 34 can be secured to the solid plate 18 and can extend from the solid plate 18. Each rod 34 can have a proximal end 38 received within a different one of the plurality of circular apertures 30. Thus, each aperture 30 can have a respective rod 34 extending therefrom. Each rod 34 can be cylindrical and a respective aperture 30 can be cylindrical. A cross-sectional diameter of the rod 34 is substantially equal to a cross-sectional diameter of the respective aperture 30. In one aspect, the proximal ends 38 of the rods 34 can be flush with the planar back side 22 of the solid plate 18 and substantially flush with the wall 16. In addition, the rods 34 do not extend past the plate 18 so that the wall is not marred and extra holes in the wall are not required. In one aspect, the rods 34 can be formed of metal, such as cut from bar stock. In another aspect, the rods 34 can be pipes. The pipes can have a hollow interior to reduce the weight with respect to solid rods, and can reduce the weight of the bracket 10 and the force exerted on the connection to the wall.

The proximal ends 38 can be joined to the plate 18 at the back side 22 of the plate 18 and around a cross-sectional perimeter that is shared between the apertures 30 and the rods 34 by welds 40. Since the cross-sectional perimeter of the apertures 30 is circular, the welds 40 (FIG. 4) can be circumferential and circular. As shown, the welds 40 can traverse the entire cross-sectional perimeter (e.g., circumference) of the apertures 30, thereby encompassing the cross-sectional perimeter. Thus, the plurality of circumferential welds 40 each join the proximal end 38 of each respective rod 34 to the planar back side 22 of the plate 18 around a perimeter of the respective circular aperture 30. And the plurality of circumferential welds 40 is locate at the planar back side 22 of the plate 18. In one aspect, the welds 40 can be fill welds and ground so that the welds 40 also are flush with the back side 22 of the plate 18 and the wall 16. The extension of the rods 34 through the plate 18 and the position of the welds on the back side 22 of the plate 18 enable the rods 34 to support more shelf weight than brackets in which elongate members are merely spot-welded to the front of a base.

The bracket 10 can receive and support the shelf 14. The shelf 14 can have a solid top surface 42, a solid bottom surface 46, a solid left surface 50, a solid right surface 54 and a solid front surface 58. The solid surfaces can conceal the bracket 10. The shelf 14 can also have a back side 62 to abut to the wall 16. The shelf 14 also has an indentation 66 in the back side 62 that is sized and shaped to receive the solid plate 18 completely therein. The shelf 14 also has a plurality of bores 70 or channels in the indentation 66 each sized and shaped to receive a corresponding rod 34. Thus, the entire bracket 10 can be received in the shelf 14 to hide the bracket 10 from view.

In one aspect, the plate 18 can have at least one cutout 74 (FIG. 13) at a lateral end. A recess 78 (FIG. 13) can be formed between an interior perimeter of the indentation 66 and an exterior perimeter of the solid plate 18 defined by the cutout 74. The cutout 74 and the recess 78 can be sized to receive a tool to help separate the bracket 10 from the shelf 14. Thus, the shelf 14 and the bracket 10 can be shipped together with the bracket 10 received in the shelf 14, and the cutout 74 and the recess 78 facilitating separation and removal of the bracket 10 from the shelf 14 for mounting.

In one aspect, a width of the plate 18 is no greater than a width of the shelf 14 and a height of the plate 18 is no greater than a height of the shelf 14 in order to reduce visibility of the bracket 10 when the shelf 14 is secured to the wall using the bracket 10. In another aspect, the plate 18 can have a height less than or equal to 1 inch while the shelf 14 can have a height or thickness of at least 1¼ inches. In another aspect, the plate 18 can have a height less than or equal to 1¼ inches while the shelf 14 can have a height or thickness of at least 1½ inches. In another aspect, the plate 18 can have a height less than or equal to 1½ inches while the shelf 14 can have a height of at least 1¾ inches. Thus, a perimeter lip 76 (FIG. 13) can be formed by the shelf 14 that extends around the indentation 66 to hide the plate 18 and be sufficiently thick to resist breakage of the perimeter lip 76. In one aspect, a thickness of the perimeter lip 76 can be at least ⅛ inches. In addition, the height of the plate 18 allows dimensional lumber to be used for the shelf 14.

The bracket 10 and the plate 18 can have bores through the plate 18 to receive fasteners 80 (FIG. 7-10) to secure the bracket 10 to the wall 16. An array of countersunk bores 82 can extend through the solid plate 18 and arranged in series and extending laterally from one lateral side of the solid plate 18 to an opposite lateral side of the solid plate. The countersunk bores 82 can have enlarged openings to receive a head of the fastener 80 so that the head is received in the volume of the plate 18 to resist interference of the head with the shelf 14 or surface panels, as described below. In one aspect, the enlarged opening can be tapered. In another aspect, the enlarged opening can define a step in the bore 82 which the head of the fastener 80 can abut to in order to fasten the plate 18 and the bracket 10 to the wall 16. In one aspect, the countersunk bores of the array of countersunk bores 82 can be spaced-apart by 4 inches from proximal bores. Thus, a number of bores 82 can be provided to strengthen the shelf 14 and the connection of the bracket 10 to the wall 16. In addition, the bores 82 can correspond to stud spacing based on a standard 16 inch spacing.

In addition, the bores can comprise an array of slots 86 extending through the solid plate 18 and arranged in series and extending laterally from one lateral side of the solid plate 18 to an opposite lateral side of the solid plate. In one aspect, the slots 86 can be laterally elongated and can have a lateral width between ⅞ and 1.77 inches. In another aspect, many of the slots 86 can be provided in pairs. For example, a pair of slots 86 can be positioned between proximal bores 82. The bores 82 and the slots 86 of the arrays of bores and slots 82 and 86 can be interleaved with one or more slots 86 between proximate bores 82 and one or more bores 82 between proximate slots 86 or slot pairs. The size and location of the bores 82 and the slots 86 can provide multiple strong attachments to the wall and frequent alignment with studs in the wall.

The bores 82 and the slots 86, and thus the fasteners, can be positioned closer to the top side of the plate 18. Positioning the bores 82 and the slots 86 at the top of the plate 18 positions the fasteners closer to the top of the plate 18 and utilized the bottom of the plate 18 to abut to the wall to resist torque loads on the bracket 10 and the plate 18 due to downward vertical loads on the shelf 14, such as the weight of objects on the shelf.

The bores 82 and slots 86 can be separated by intervening portions of the plate 18, such as webs 90. Thus, an array of webs 90 can be positioned in the plate 18 and interleaved between proximate bores 82 and slots 86. In one aspect, each web 90 can have a lateral width less than or equal to ¾ inch. Thus, the spacing between proximate bores 82 and slots 86 can be less than ¾ inch. Therefore, the bores 82 and/or the slots 86 can be positioned to align with available studs of the wall 16. In addition, the webs 90 on either side of a rode 34, and between a rod 34 and a proximate bore 82 and/or slot 86, can be less than ¾ inch. Therefore, the fasteners 80 can be positioned proximate the rods 34 to reduce torque loading at the interface or connection between the rods 34 and the plate 18.

In another aspect, the rods 34 can have a center-line indicia, such as a notch 94 (FIG. 3) or scribe. The indicia or notch 94 can pass vertically through a center-line of each rod 34. The indicia or notch 94 facilitates measuring a distance between two rods 34. Thus, the rod spacing can be measured for drilling the bores 70 or channels in the shelf 14.

Figure 7:
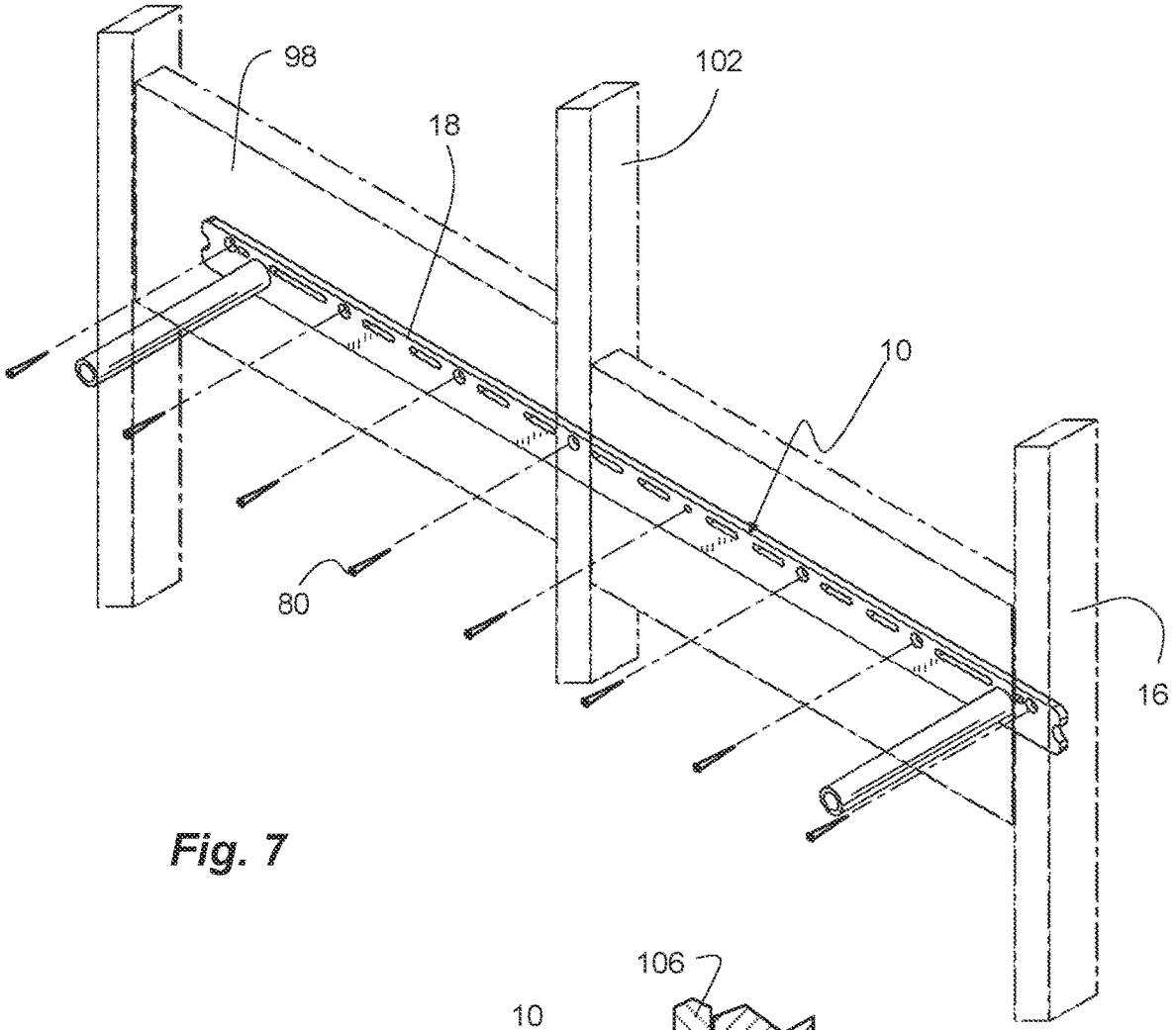
FIG. 7 is a schematic perspective view of a method for mounting the bracket of FIG. 1 to blocking of a wall.
Figure 8:
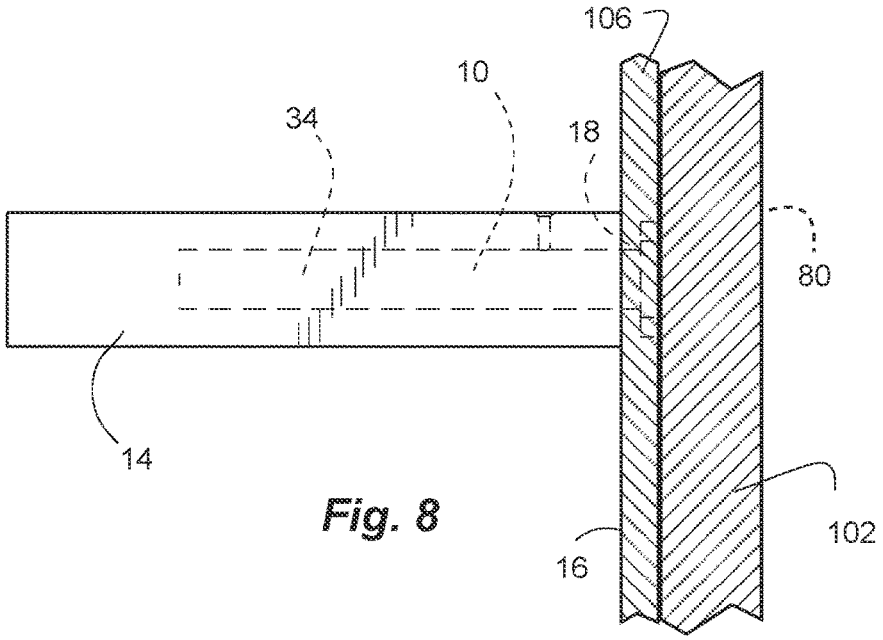
FIG. 8 is a schematic side view of the bracket and the floating shelf of FIG. 1, shown mounted to the blocking of the wall.

FIGS. 7 and 8 illustrate a method for hanging and mounting the bracket 10 on the wall 16. Blocking 98 can be secured between studs 102 in the wall 16, The bracket 10 and the plate 18 can be placed against the blocking 98 and the studs 102. The plate 18 can be secured to the blocking 98 and the studs 102 with fasteners 80 extending through the countersunk bores 82 of the array of countersunk bores 82, and into the blocking 98 and the studs 102. The array of bores 82 provides multiple attachment points between the plate 18 and the wall 16 for a strong mount. A surface panel 106 can be placed over the plate 18 with the rods 38 extending through holes in the surface panel 106. The surface panel 106 can be drywall, shiplap, etc. The countersunk bores 82 allow the heads of the fasteners 80 to be recessed into the plate 18 so that the surface panel 106 can be positioned flush with the plate 18. Thus, the plate 18 can be subsurface mounted in an interior of the wall 16 and behind the surface panel 106. The shelf 14 can be slid onto the bracket 10 with the bores 70 receiving the rods 34 and the indentation 66 receiving the plate 18. The bracket 10 can be used in new construction or remodels, i.e. before finished surface panels 106 are installed. Securing the bracket 10 and the plate 18 directly to the blocking 98 and/or the studs 102 can provide greater strength. The array of bores 82 provides multiple attachment points.

Figure 9:
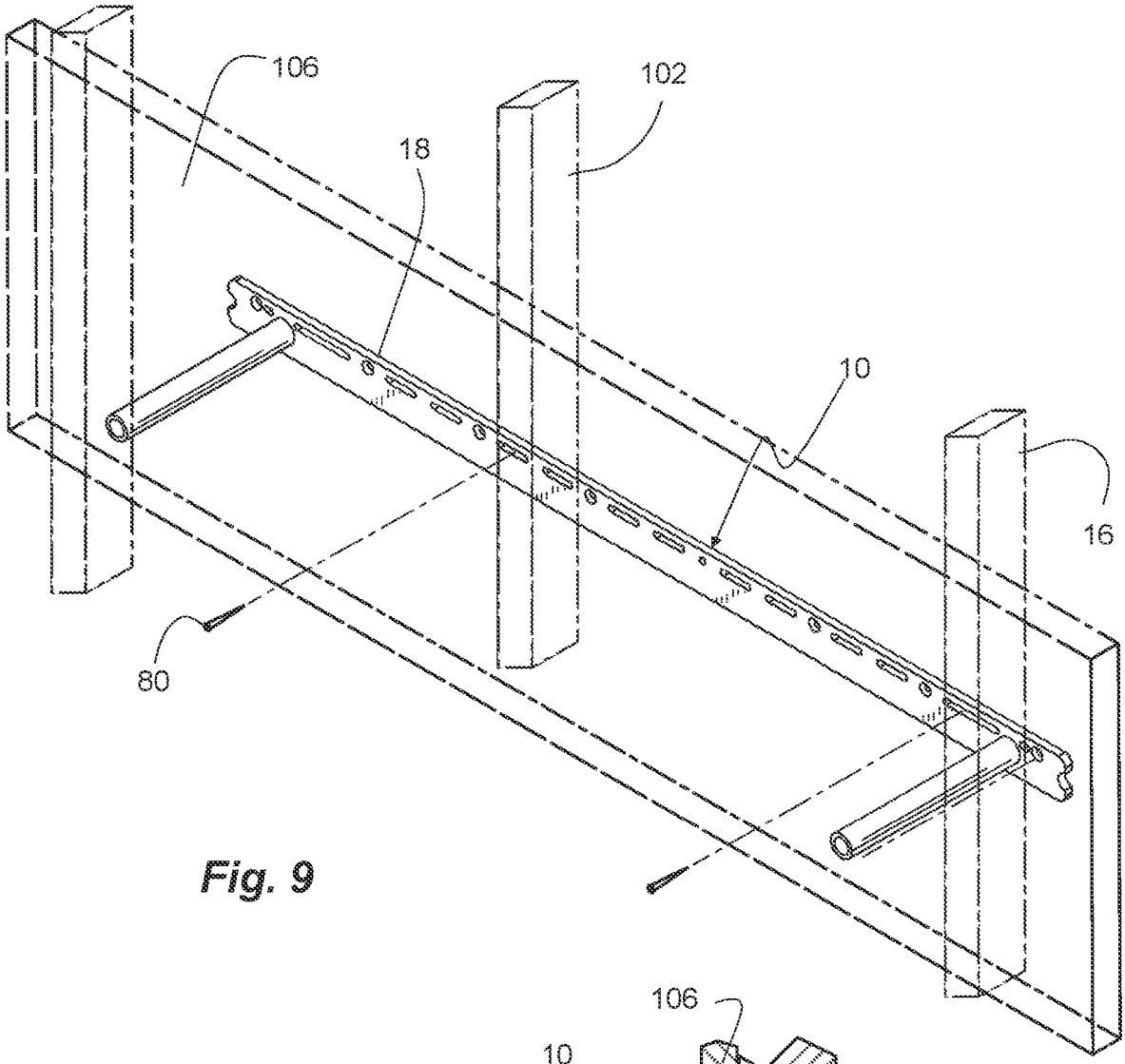
FIG. 9 is a schematic perspective view of a method for mounting the bracket of FIG. 1 to a surface panel of a wall.
Figure 10:
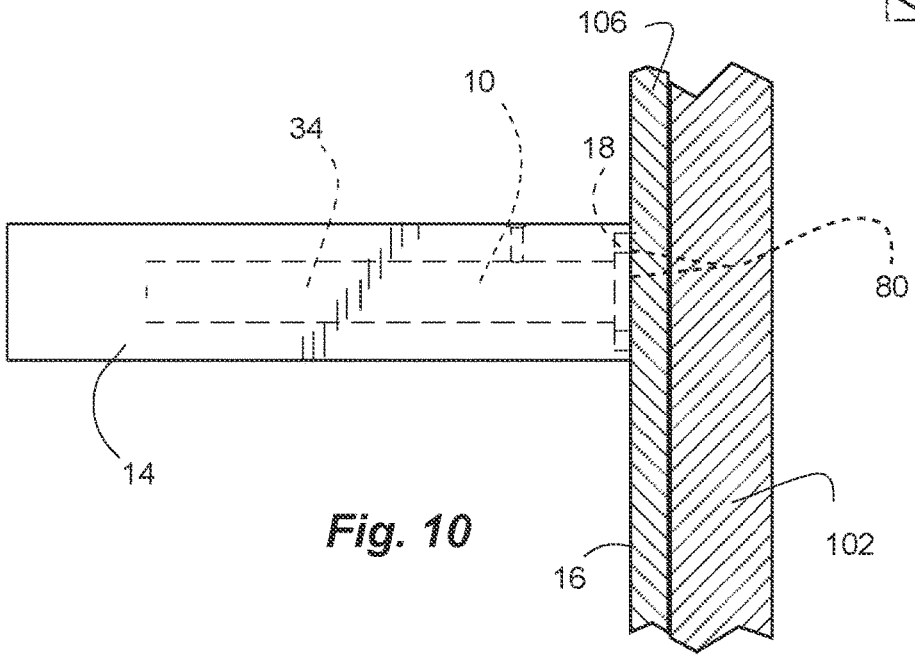
FIG. 10 is a schematic side view of the bracket and the floating shelf of FIG. 1, shown mounted to the surface panel of the wall.
Figure 11:
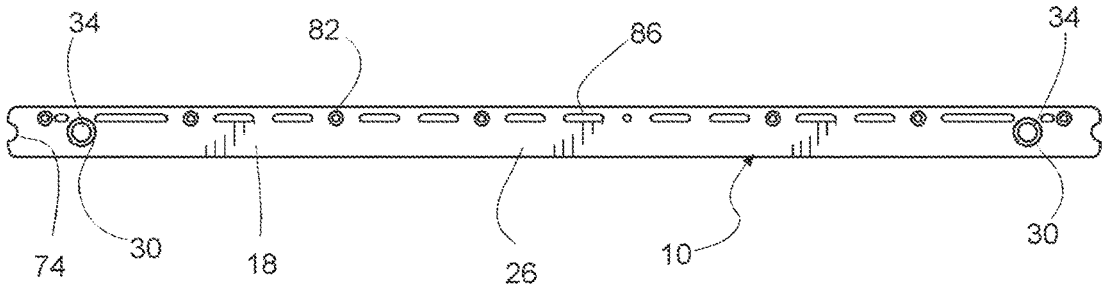
FIG. 11 is a front view of the bracket of FIG. 1.
Figure 12:
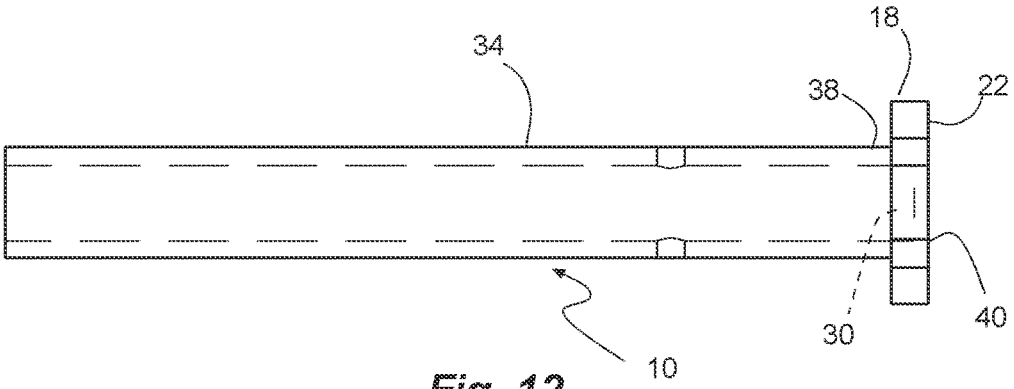
FIG. 12 is a side view of the bracket of FIG. 1.
Figure 13:
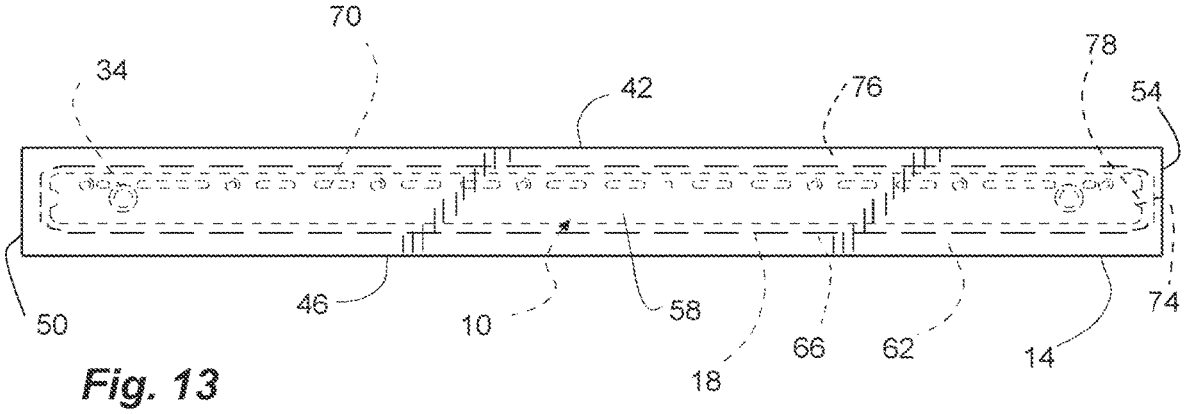
FIG. 13 is a front view of the floating shelf of FIG. 1.
Figure 14:
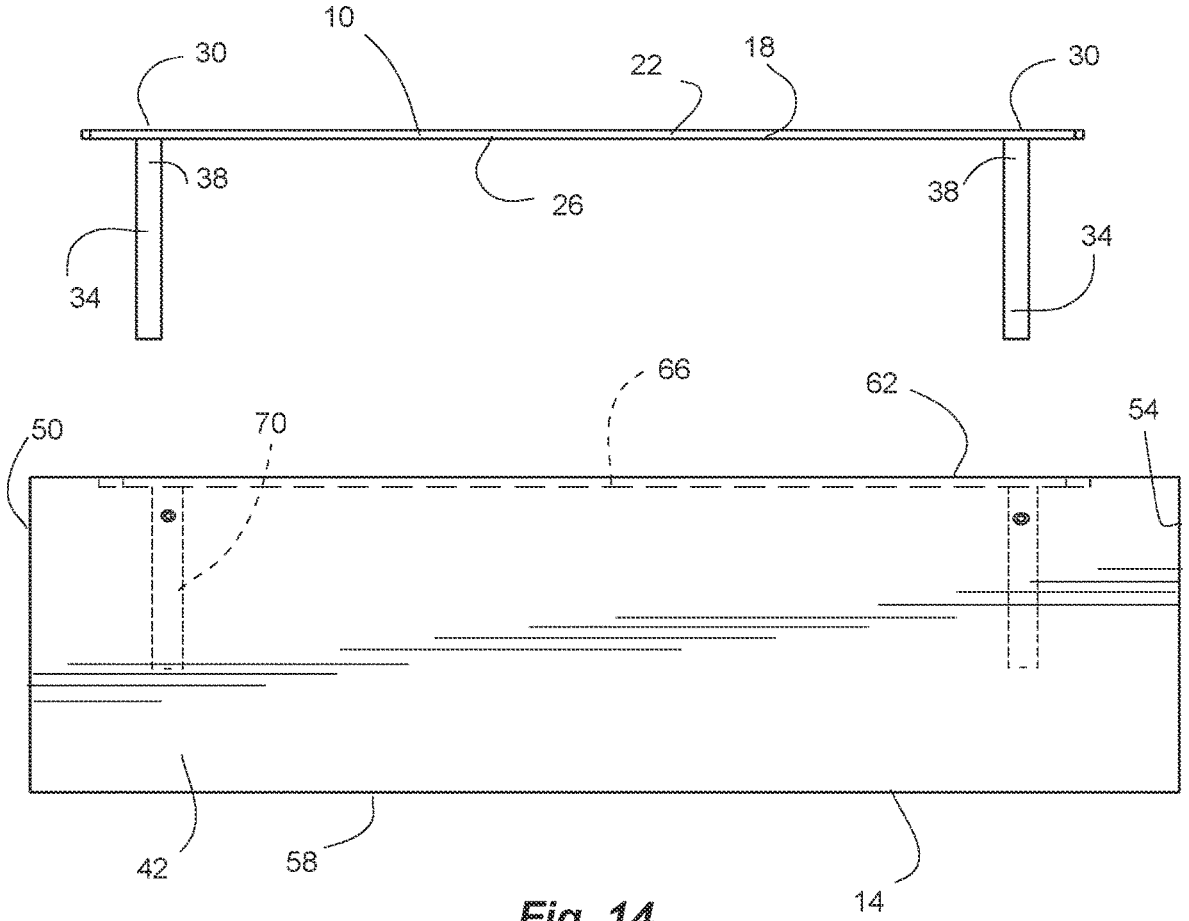
FIG. 14 is an exploded top view of the bracket and the floating shelf of FIG. 1.
Figure 15:
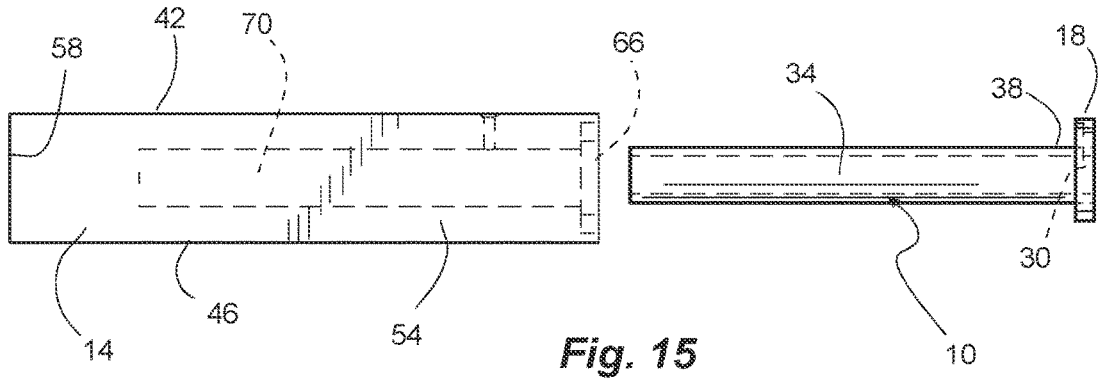
FIG. 15 is an exploded side view of the bracket and the floating shelf of FIG. 1.

FIGS. 9 and 10 illustrate a method for hanging and mounting the bracket on the wall 16. The studs 102 can be located in the wall 16 behind the surface panel 106. The bracket 10 and the plate 18 are placed against the surface panel 102 of the wall 16. Thus, the plate 18 can be surface mounted to an exterior of the wall 16, At least two slots 86 can be aligning with a different one of the studs 102. The plate 18 can be secured to the wall 16 with fasteners 80 extending through the at least two slots 86, through the surface panel 106 and into the studs 102. The shelf 14 can be slid onto the bracket 10 with the bores 70 receiving the rods 34 and the indentation 66 receiving the plate 18. The bracket 10 can be used on finished surfaces and existing construction. The array of slots 86 provides easier alignment with existing stud locations.

The bracket 10 and the plate 18 can be provided in a number of different lateral widths or lengths, such as 10", 14", 18", 22", 26", 30", 34", 38", 42", 46', 50", 54", 58", 70" or 78" in order to suite the desired shelf width or length. The bracket 10 and the plate 18 can be provided with a number of different rods, such as 2, 3, 4 or 5 rods. As described above, the plate 18 can have a height of approximately 1", 1¼" or 1¾". In addition, the plate 18 can have a thickness of approximately 114" or ⅜". The rods 34 can have a length or depth of approximately 6" to 10" from the front side 26 of the plate 18 and a diameter of approximately ½" to ¾". The pipes 34 can have a wall thickness of approximately 0.12". The slots 86 can be approximately 0.20" high and ⅞-1.77" long, and can be spaced 1⅝" on center. In another aspect, the rods 34 can be located approximately 2" from the ends of the plate 18 to reduce torque loads. Thus, the bracket 10 and the plate 18 can have at least one bore 82 and/or slot 86 a rod 34 and the end of the plate 18 to facilitate mounting.

Figure 16:
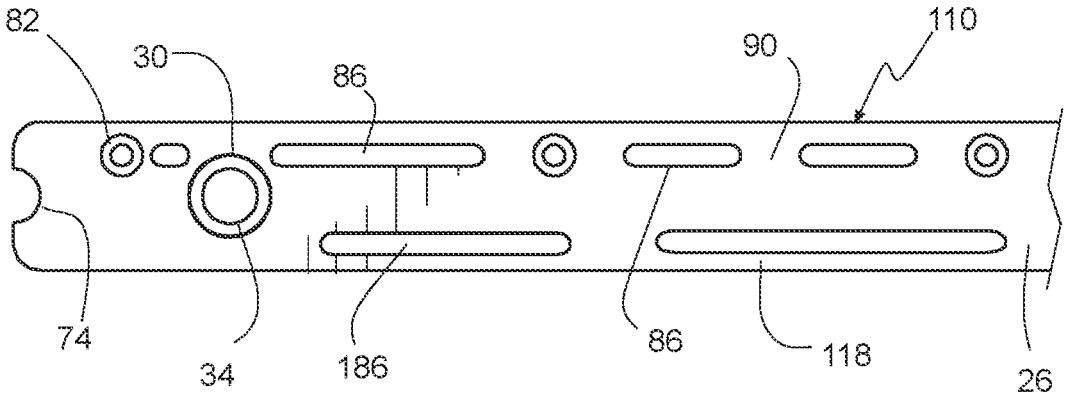
FIG. 16 is a partial front view of a bracket in accordance with an embodiment of the invention.

Referring to FIGS. 16, in one aspect, the bracket 110 and the plate 118 can have a lower array of bores and/or slots 186 positioned near a lower edge or bottom of the bracket 110 and the plate 118. The bores and/or slots 186 can extend through the solid plate 118 and can be arranged in series extending laterally from one lateral side of the solid plate 118 to an opposite lateral side of the solid plate. The bores and/or slots 186 can be countersunk. Positioning the bores and/or slots 186 at the bottom of the plate 118 can position a fasteners closer to the bottom of the plate 118 to utilize the top of the plate 118 to abut to the wall to resist torque loads on the bracket 110 and the plate 118 due to upward vertical loads on the shelf 14. While most loading on the shelf 14 is anticipated to be vertically downward due to the weight of objects on the shelf 14, there may be circumstances where a vertically upward force is applied, such as someone lifting the shelf. In addition, in the case where the upper bores 82 and upper slots 86 are cut into the plate 118 with a laser, the lower bores and/or slots 186 can reduce or resist warpage of the plate 118 due to the heat generated by the laser cutting by balancing the heat across the plate 118.

As used in this specification and the appended claims, the singular forms "a," "an" and "the" include plural referents unless the context clearly dictates otherwise. Thus, for example, reference to "a layer" includes a plurality of such layers.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law, "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the composition's nature or characteristics would be permissible if present under the "consisting essentially of" language, even though not expressly recited in a list of items following such terminology. When using an open ended term in the specification, like "comprising" or "including," it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein.

The term "coupled," as used herein, is defined as directly or indirectly connected in an electrical or nonelectrical manner. Objects described herein as being "adjacent to" each other may be in physical contact with each other, in close proximity to each other, or in the same general region or area as each other, as appropriate for the context in which the phrase is used. Occurrences of the phrase "in one embodiment," or "in one aspect," herein do not necessarily all refer to the same embodiment or aspect.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, the term "about" is used to provide flexibility to a numerical range endpoint by providing that a given value may be "a little above" or "a little below" the endpoint. It is understood that express support is intended for exact numerical values in this specification, even when the term "about" is used in connection therewith.

It is to be understood that the examples set forth herein are not limited to the particular structures, process steps, or materials disclosed, but are extended to equivalents thereof as would be recognized by those ordinarily skilled in the relevant arts. It should also be understood that terminology employed herein is used for the purpose of describing particular examples only and is not intended to be limiting.

Furthermore, the described features, structures, or characteristics may be combined in any suitable manner in one or more examples. In the description, numerous specific details are provided, such as examples of lengths, widths, shapes, etc., to provide a thorough understanding of the technology being described. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the invention in one or more particular applications, it will be apparent to those of ordinary skill in the art that numerous modifications in form, usage and details of implementation can be made without the exercise of inventive faculty, and without departing from the principles and concepts described herein. Accordingly, it is not intended that the invention be limited, except as by the claims set forth below.

What is claimed is:

1. A bracket for a floating shelf, the bracket comprising:

a solid plate with a planar back side configured to abut to a wall and a planar front side;

a plurality of circular apertures, each aperture extending through the solid plate from the planar front side of the solid plate and through the back side of the solid plate;

a plurality of rods secured to the solid plate and extending therefrom, with each rod having a proximal end received within a different one of the plurality of circular apertures;

the proximal ends of the plurality of rods being flush with the planar back side of the solid plate and configured to be substantially flush with the wall;

an array of bores extending through the solid plate and arranged in series and extending laterally from one lateral side of the solid plate to an opposite lateral side of the solid plate;

an array of slots extending through the solid plate and arranged in series and extending laterally from one lateral side of the solid plate to an opposite lateral side of the solid plate;

the bores and the slots of the arrays of bores and slots being interleaved;

an array of webs in the plate and interleaved between the array of slots and the array of bores; and each bore having a width, each slot having a width, and each web having a width, a total of the widths of the bores and the slots being greater than a total of the widths of the webs.

2. The bracket in accordance with claim 1, further comprising:

a shelf having solid top, bottom, left, right and front surfaces;

the shelf having a back side configured to abut to the wall;

an indentation in the back side and sized and shaped to receive the solid plate completely therein;

a plurality of bores in the indentation each sized and shaped to receive a different one of the plurality of rods;

the plate having a height less than a height of the shelf to form a perimeter lip in the shelf extending around the indentation; and the perimeter lip having a thickness of at least ⅛ inches.

3. The bracket in accordance with claim 1, further comprising:

an etch mark at a center of each rod of the plurality of rods.

4. The bracket in accordance with claim 1, wherein the solid plate has an elongated rectangular shape with a rectangular perimeter and at least one cutout at a lateral end.

5. The bracket in accordance with claim 4, further comprising:

a shelf having solid top, bottom, left, right and front surfaces;

the shelf having a back side configured to abut to the wall;

an indentation in the back side and sized and shaped to receive the solid plate completely therein;

a plurality of bores in the indentation each sized and shaped to receive a different one of the plurality of rods; and a recess between an interior perimeter of the indentation and an exterior perimeter of the solid plate defined by the cutout and sized to receive a tool to separate the bracket from the shelf.

6. A method for hanging the bracket in accordance with claim 1 on the wall, the method comprising:

locating studs in the wall behind a surface panel;

placing the bracket against the surface panel of the wall;

aligning at least two slots of the array of slots with a different one of the studs; and securing the plate to the wall with fasteners extending through the at least two slots, through the surface panel and into the studs.

7. A method for hanging the bracket in accordance with claim 1 on the wall, the method comprising:

securing blocking between studs in the wall;

placing the bracket against the blocking and studs;

securing the plate to the blocking with fasteners extending through the bores of the array of bores, and into the blocking;

placing surface panel over the plate with the rods extending through holes in the surface panel.

8. The bracket in accordance with claim 1, wherein the bores of the array of bores are spaced-apart by 4 inches from proximal bores.

9. The bracket in accordance with claim 1, in combination with the floating shelf, the floating shelf further comprising:

solid top, bottom, left, right and front surfaces;

a back side configured to abut to the wall;

an indentation in the back side and sized and shaped to receive the solid plate completely therein; and a plurality of bores in the indentation each sized and shaped to receive a different one of the plurality of rods.

10. The bracket in accordance with claim 1, further comprising:

the array of bores and the array of slots being positioned near a top of the plate; and a lower array of bores and/or slots positioned near a bottom of the plate.

11. A bracket for a floating shelf, the bracket comprising:

a solid plate with a planar back side configured to abut to a wall and a planar front side;

a plurality of circular apertures, each aperture extending through the solid plate from the planar front side of the solid plate and through the back side of the solid plate;

a plurality of rods secured to the solid plate and extending therefrom, with each rod having a proximal end received within a different one of the plurality of circular apertures;

the proximal ends of the plurality of rods being flush with the planar back side of the solid plate and configured to be substantially flush with the wall;

an array of bores extending through the solid plate and arranged in series and extending laterally from one lateral side of the solid plate to an opposite lateral side of the solid plate;

an array of slots extending through the solid plate and arranged in series and extending laterally from one lateral side of the solid plate to an opposite lateral side of the solid plate;

the bores and the slots of the arrays of bores and slots being interleaved;

an array of webs in the plate interleaved between the array of slots and the array of bores; and each bore having a width, each slot having a width, and each web having a width, a total of the widths of the bores and the slots being greater than a total of the widths of the webs.

12. The bracket in accordance with claim 11, further comprising:

a shelf having solid top, bottom, left, right and front surfaces;

the shelf having a back side configured to abut to the wall;

an indentation in the back side and sized and shaped to receive the solid plate completely therein;

a plurality of bores in the indentation each sized and shaped to receive a different one of the plurality of rods;

the plate having a height less than a height of the shelf to form a perimeter lip in the shelf extending around the indentation; and the perimeter lip having a thickness of at least ⅛ inches.

13. The bracket in accordance with claim 11, further comprising:

an etch mark at a center of each rod of the plurality of rods.

14. The bracket in accordance with claim 11, further comprising:

the solid plate having an elongated rectangular shape with a rectangular perimeter and at least one cutout at a lateral end;

a shelf having solid top, bottom, left, right and front surfaces;

the shelf having a back side configured to abut to the wall;

an indentation in the back side and sized and shaped to receive the solid plate completely therein;

a plurality of bores in the indentation each sized and shaped to receive a different one of the plurality of rods; and a recess between an interior perimeter of the indentation and an exterior perimeter of the solid plate defined by the cutout and sized to receive a tool to separate the bracket from the shelf.

15. A method for hanging the bracket in accordance with claim 11 on the wall, the method comprising:

locating studs in the wall behind a surface panel;

placing the bracket against the surface panel of the wall;

aligning at least two slots of the array of slots with a different one of the studs; and securing the plate to the wall with fasteners extending through the at least two slots, through the surface panel and into the studs.

16. A method for hanging the bracket in accordance with claim 11 on the wall, the method comprising:

securing blocking between studs in the wall;

placing the bracket against the blocking and studs;

securing the plate to the blocking with fasteners extending through the bores of the array of bores, and into the studs;

placing surface panel over the plate with the rods extending through holes in the surface panel.

17. The bracket in accordance with claim 11, wherein the bores of the array of bores are spaced-apart by 4 inches from proximal bores.

18. The bracket in accordance with claim 11, in combination with the floating shelf, the floating shelf further comprising:

solid top, bottom, left, right and front surfaces;

a back side configured to abut to the wall;

an indentation in the back side and sized and shaped to receive the solid plate completely therein; and a plurality of bores in the indentation each sized and shaped to receive a different one of the plurality of rods.

19. A bracket and a floating shelf, the bracket comprising:

a solid plate with a planar back side configured to abut to a wall and a planar front side;

a plurality of circular apertures, each aperture extending through the solid plate from the planar front side of the solid plate and through the back side of the solid plate;

a plurality of rods secured to the solid plate and extending therefrom, with each rod having a proximal end received within a different one of the plurality of circular apertures;

the proximal ends of the plurality of rods being flush with the planar back side of the solid plate and configured to be substantially flush with the wall;

the solid plate having an elongated rectangular shape with a rectangular perimeter and at least one cutout at a lateral end;

an array of bores extending through the solid plate and arranged in series and extending laterally from one lateral side of the solid plate to an opposite lateral side of the solid plate;

an array of slots extending through the solid plate and arranged in series and extending laterally from one lateral side of the solid plate to an opposite lateral side of the solid plate;

the bores and the slots of the arrays of bores and slots being interleaved;

an array of webs in the plate and interleaved between the array of slots and the array of bores; and each bore having a width, each slot having a width, and each web having a width, a total of the widths of the bores and the slots being greater than a total of the widths of the webs;

the shelf having solid top, bottom, left, right and front surfaces;

the shelf having a back side configured to abut to the wall;

an indentation in the back side and sized and shaped to receive the solid plate completely therein; and a plurality of bores in the indentation each sized and shaped to receive a different one of the plurality of rods.

20. The bracket in accordance with claim 1, further comprising:

the array of slots being located closer to a top of the plate than a bottom of the plate, and the array of slots being located above a center of the circular apertures.

* * * * *